US010012454B2

(12) United States Patent
Hu et al.

(10) Patent No.: US 10,012,454 B2
(45) Date of Patent: Jul. 3, 2018

(54) HEAT DISSIPATION DEVICE AND METHOD FOR MANUFACTURING SAME

(71) Applicants: FuKui Precision Component (Shenzhen) Co., Ltd., Shenzhen (CN); Zhen Ding Technology Co., Ltd., Tayuan, Taoyuan (TW)

(72) Inventors: Xian-Qin Hu, Shenzhen (CN); Fu-Yun Shen, Shenzhen (CN); Ming-Jaan Ho, New Taipai (TW)

(73) Assignees: Avary Holding (Shenzhen) Co., Limited., Shenzhen (CN); GARUDA TECHNOLOGY CO., LTD, New Taipei (TW)

( * ) Notice: Subject to any disclaimer, the term of this patent is extended or adjusted under 35 U.S.C. 154(b) by 417 days.

(21) Appl. No.: 14/691,258

(22) Filed: Apr. 20, 2015

(65) Prior Publication Data

US 2016/0061540 A1 Mar. 3, 2016

(30) Foreign Application Priority Data

Sep. 2, 2014 (CN) ..... 2014 1 0442149

(51) Int. Cl.

| | |
|---|---|
| ***F28F 21/08*** | (2006.01) |
| ***F28F 3/04*** | (2006.01) |
| ***F28D 15/02*** | (2006.01) |

(52) U.S. Cl.

CPC ..... *F28F 21/085* (2013.01); *F28D 15/02* (2013.01); *F28F 3/048* (2013.01); *F28F 2275/025* (2013.01)

(58) Field of Classification Search

None

See application file for complete search history.

(56) References Cited

U.S. PATENT DOCUMENTS

| | | | | |
|---|---|---|---|---|
| 5,697,428 | A * | 12/1997 | Akachi | F28D 15/0233 165/104.14 |
| 2009/0154103 | A1* | 6/2009 | Liu | H01L 23/427 361/700 |
| 2015/0101785 | A1* | 4/2015 | Ho | F28F 21/085 165/170 |

FOREIGN PATENT DOCUMENTS

| | | | |
|---|---|---|---|
| CN | 2484512 | | 4/2002 |
| CN | 202403584 | | 8/2012 |
| JP | 2004-93127 | A * | 3/2004 |

OTHER PUBLICATIONS

Machine Translation of Japanese Patent 2004-93127, Date Unknown.*

* cited by examiner

*Primary Examiner* — Jeffry H Aftergut

(74) *Attorney, Agent, or Firm* — ScienBiziP, P.C.

(57) ABSTRACT

A heat dissipation device includes a first copper sheet and a second copper sheet. The first copper sheet includes a number of first recesses and the second copper sheet includes a number of corresponding second recesses. The second copper sheet is fixed on the first copper sheet and an airtight receiving cavity is formed by each first recess and each the second recess, a working fluid in the airtight receiving cavity carries unwanted heat away.

10 Claims, 9 Drawing Sheets

HEAT DISSIPATION DEVICE AND METHOD FOR MANUFACTURING SAME

FIELD

The subject matter herein generally relates to heat dissipation device.

BACKGROUND

Since a high-power electronic device generates a large amount of heat during operation, the performance and lifetime of the electronic device is lowered if the heat cannot be dissipated in time.

BRIEF DESCRIPTION OF THE DRAWINGS

Implementations of the present technology will now be described, by way of example only, with reference to the attached figures.

DETAILED DESCRIPTION

Figure 1:
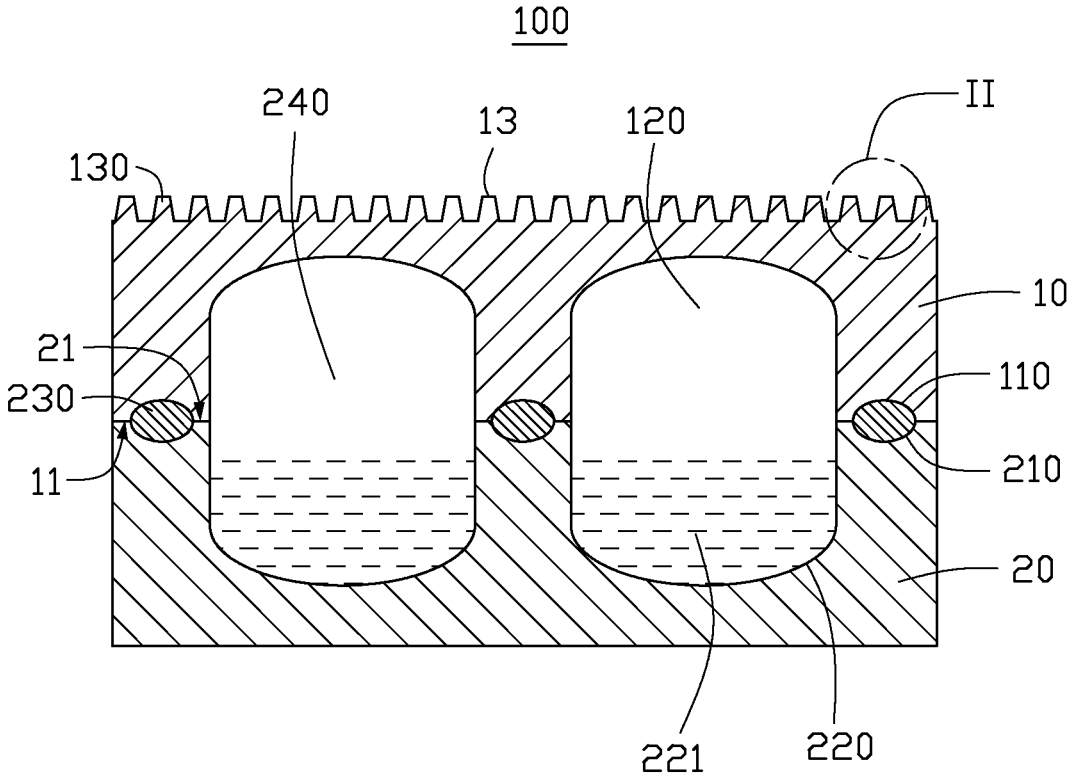
FIG. 1 is a diagrammatic view of a heat dissipation device comprising micro-fins in accordance with a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like. The references "a plurality of" and "a number of" mean "at least two."

The present disclosure is described in relation to a heat dissipation device. The heat dissipation device includes a first copper sheet and a second copper sheet. The first copper sheet includes a number of first recesses; the second copper sheet includes a number of second recesses. The second recesses correspond with the first recesses and the second copper sheet is fixed on the first copper sheet. An airtight receiving cavity is formed by each first recess and second recess together and a working fluid is received in the airtight receiving cavity.

FIG. 1 illustrates a heat dissipation device 100 according to a first embodiment. The heat dissipation device 100 includes a first copper sheet 10, a second copper sheet 20, and an adhesive 230 configured for fixing the first copper sheet 10 and the second copper sheet 20 together.

Figure 2:
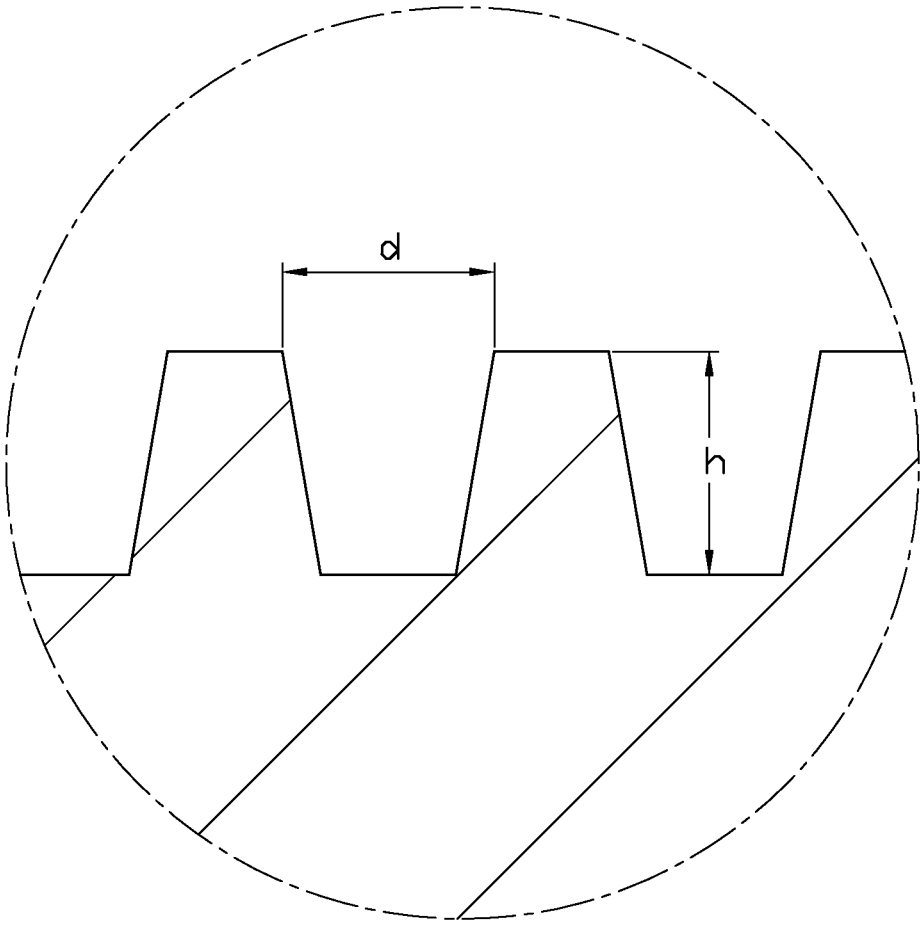
FIG. 2 is an enlarged view of the micro-fins of circled portion II in FIG. 1.
Figure 3:
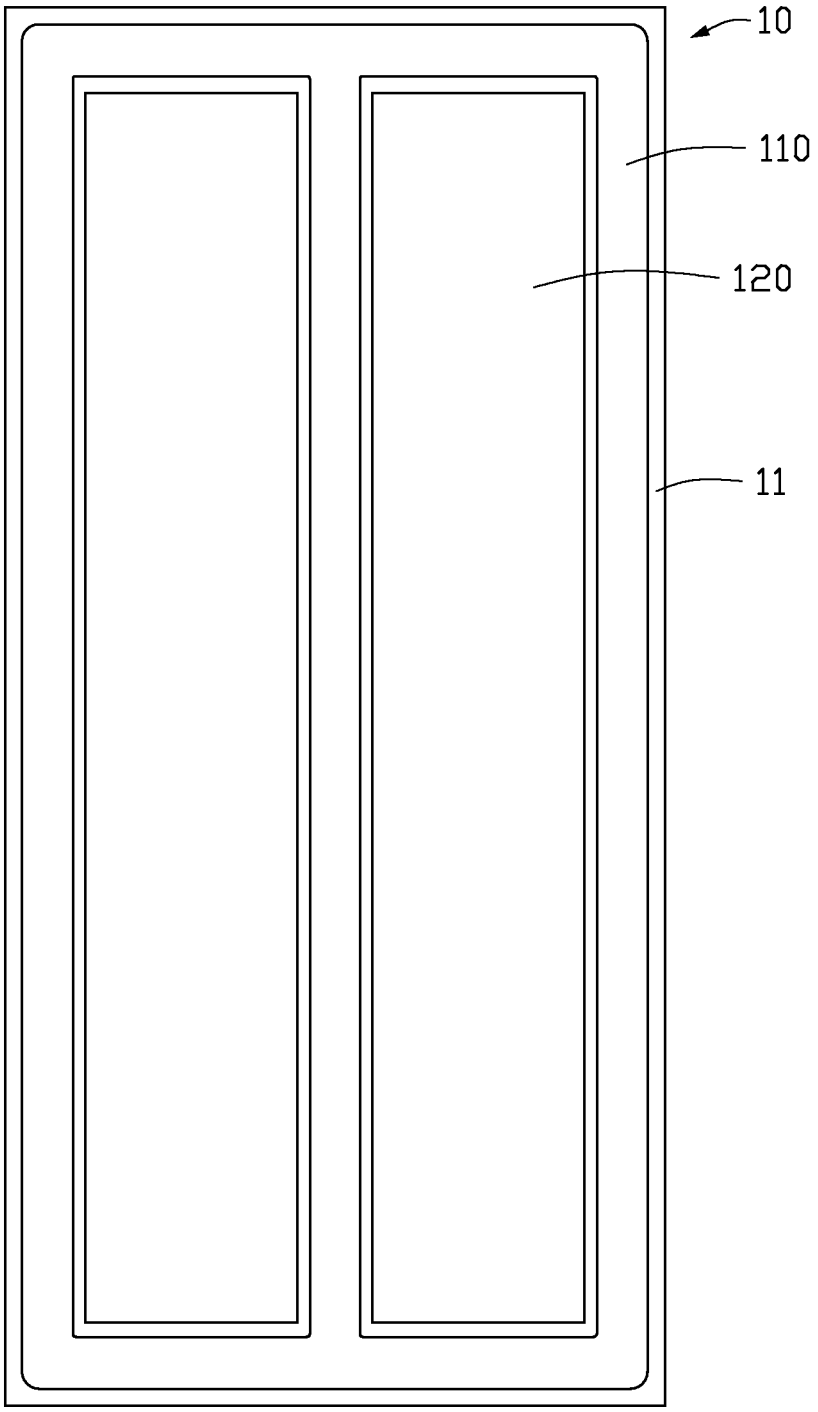
FIG. 3 is a top view of the heat dissipation device shown in FIG. 1.

The first copper sheet 10 includes a first surface 11 and a third surface 13 opposite to the first surface 11. The first surface 11 defines a number of first recesses 110 and a number of first cavities 120. Each the first recess 110 is a ring and the first recess 110 is arranged surrounding each first cavity 120, as shown in FIG. 3. A depth of each first cavity 120 is less than a thickness of the first copper sheet 10. A plurality of micro-fins 130 is formed on the third surface 13 to help for heat dissipation. A cross-sectional of the micro-fins 130 is substantially a trapezoid. A height of the trapezoid is in a range from about 3 to-8 um, and an interval between each adjacent two micro-fins is in a range from about 30 to 40 um, as shown in FIG. 2.

The second copper sheet 20 has substantially the same size as the first copper sheet 10. The second copper sheet 20 includes a second surface 21 in contact with the first surface 11. The second surface 21 defines a number of second recesses 210 respectively corresponding with the first recesses 110 and a number of second cavities 220 respectively corresponding with the first cavity 120. Each second recess 210 is a ring and is surrounded by each second cavity 220. A depth of each second recess 220 is less than a thickness of the second copper sheet 20. The second recesses 210 and the first recesses 110 have the same shape and size. The first recess 110 and the second recess 210 together are configured for receiving the adhesive 230. The first cavity 120 and the second cavity 220 together form an airtight receiving cavity 240 and are configured for receiving a working fluid 231.

A thickness of each first copper sheet 10 and second copper sheet 20 is about 140 um.

In the illustrated embodiment, the adhesive 230 is low temperature solder paste, a melting point of the low temperature solder paste is about 139° C. or less.

The working fluid 221 can be selected from the group comprising water, methanol, ethanol, acetone, ammonia, paraffin, oil, and chlorofluorocarbons at least. In the illustrated embodiment, the working fluid 221 is water. A heat capacity of water is about $4.2\times10^3$ J/(kg·° C.), which is larger than a heat capacity of copper sheet.

When the heat dissipation device 100 is used for heat dissipation, the heat dissipation device 100 is fixed with a heat generating member of an electronic device (not shown). The heat generating member can be a CPU but is not limited to CPU only. Heat generated by the heat generating member is transferred to and gathered at a bottom of the second copper sheet 20, and the heat is absorbed by the working fluid 221 in the receiving cavity 240 and is diffused through the second copper sheet 20 and the first copper sheet 10 during the heat transfer. The working fluid 221 is gradually vaporized and the water vapor is moved to an inner wall of the first cavity 120, then it condenses into small water droplets. Finally the small droplets flow into the second cavity 220, thereby, heat generated from the heat generating member of the electronic device is dissipated.

Figure 4:
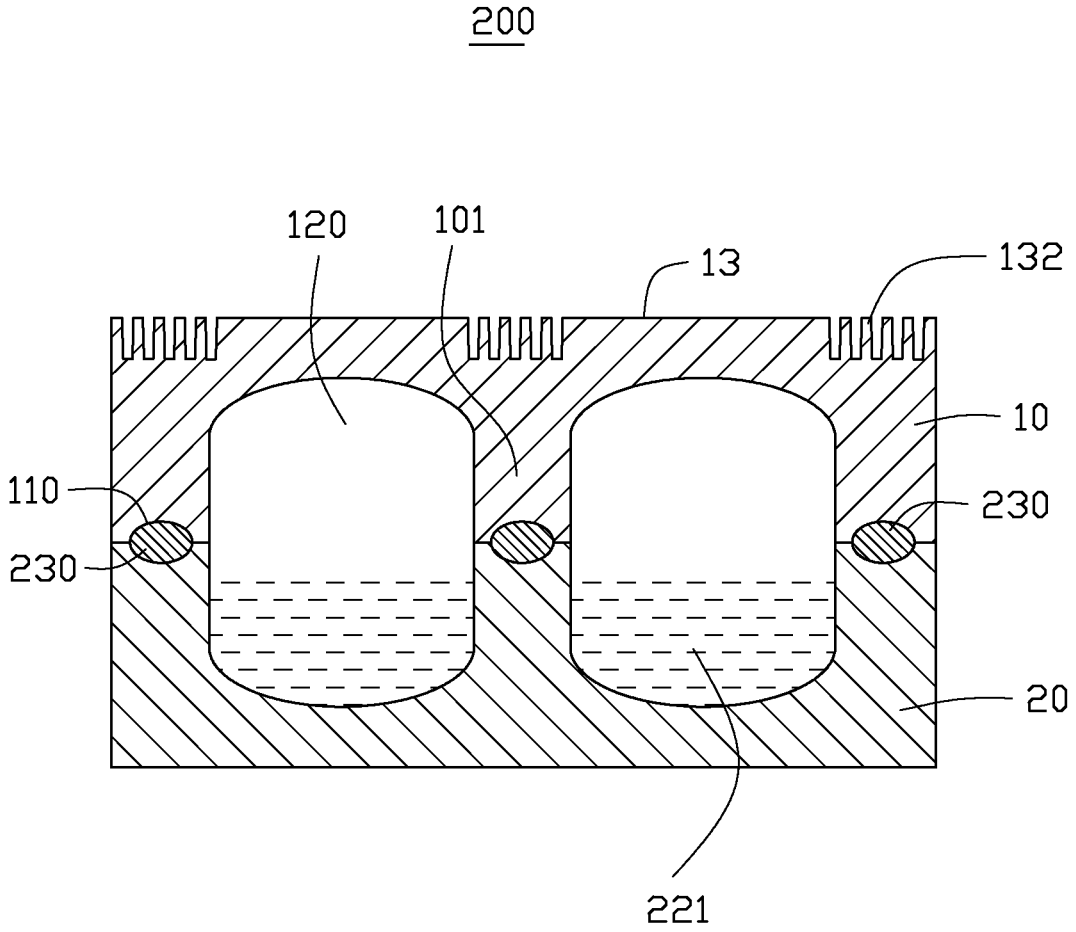
FIG. 4 is a diagrammatic view of a heat dissipation device in accordance with a second embodiment.

FIG. 4 illustrates a heat dissipation device 200 according to a second embodiment. The structure of the heat dissipation device 200 is similar to that of heat dissipation device 100. The difference is that: the first copper sheet 10 includes a plurality of ribs 101 between the first cavity 120, the micro-fins 132 are formed at a location of the third surface 13 which corresponds to the ribs 101.

Figure 5:
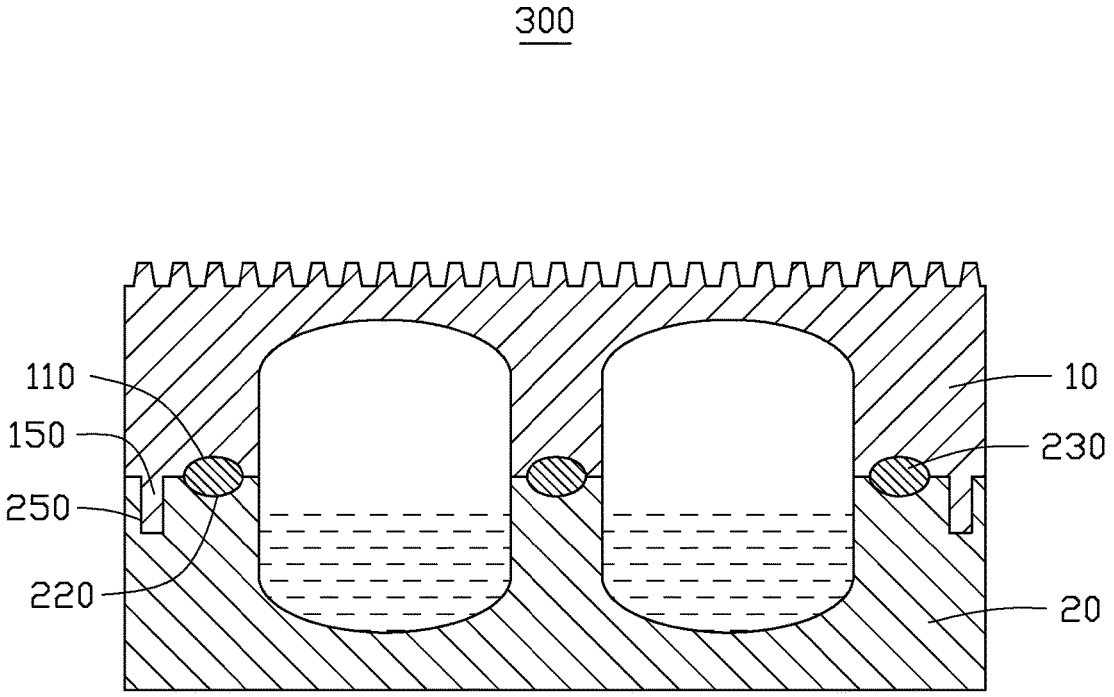
FIG. 5 is a diagrammatic view of a heat dissipation device in accordance with a third embodiment.

FIG. 5 illustrates a heat dissipation device 300 according to a third embodiment. The structure of the heat dissipation device 300 is similar to that of heat dissipation device 100. The difference is that the first copper sheet 10 includes at least one position post 150, the second copper sheet 20 includes at least one position hole 250, the position post 150 matches with the position hole 250 and is received in the position hole 250. The position post 150 and position hole 250 are configured to fix the first copper sheet 10 and the second copper sheet 20 together and prevent the first copper sheet 10 from deviating relative to the second copper sheet 20.

Figure 6:
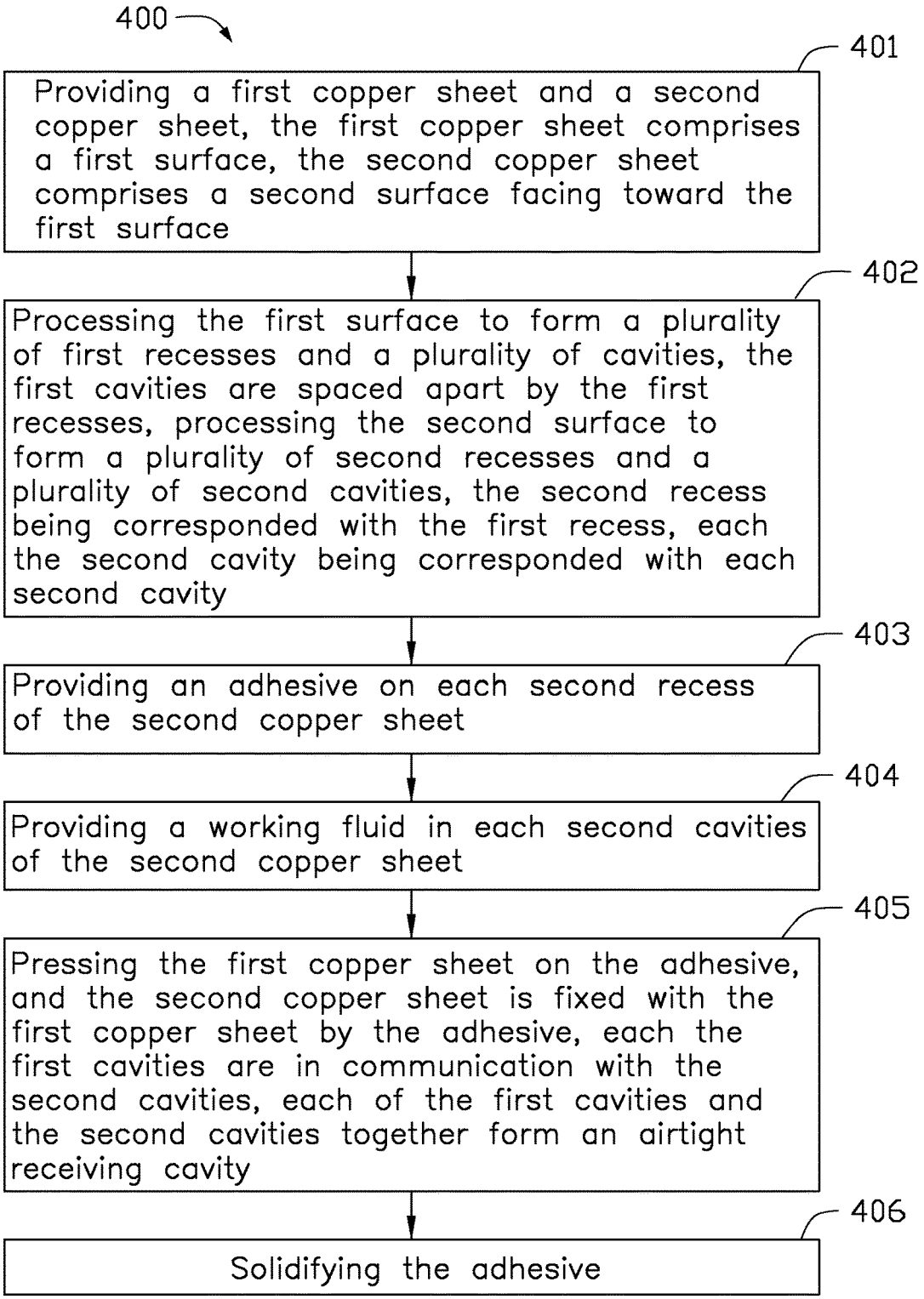
FIG. 6 illustrates a flowchart of a method for manufacturing the heat dissipation device of FIG. 1.
Figure 7:
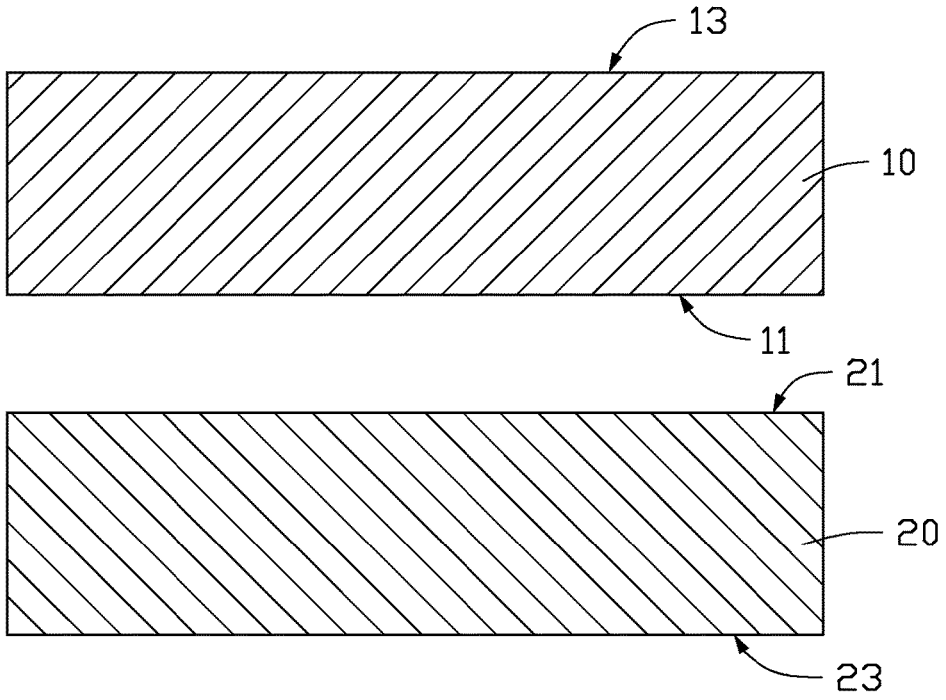
FIG. 7 illustrates a diagrammatic view of a first copper sheet and a second copper sheet provided for manufacturing the heat dissipation device.

FIG. 6 illustrates a flowchart in accordance with an example embodiment. The example method 400 for manufacturing the heat dissipation device 100 (shown in FIG. 1) is provided by way of an example, as there are a variety of ways to carry out the method. Additionally, the illustrated order of blocks is by example only and the order of the blocks can change. The method 400 can begin at block 401.

Figure 8:
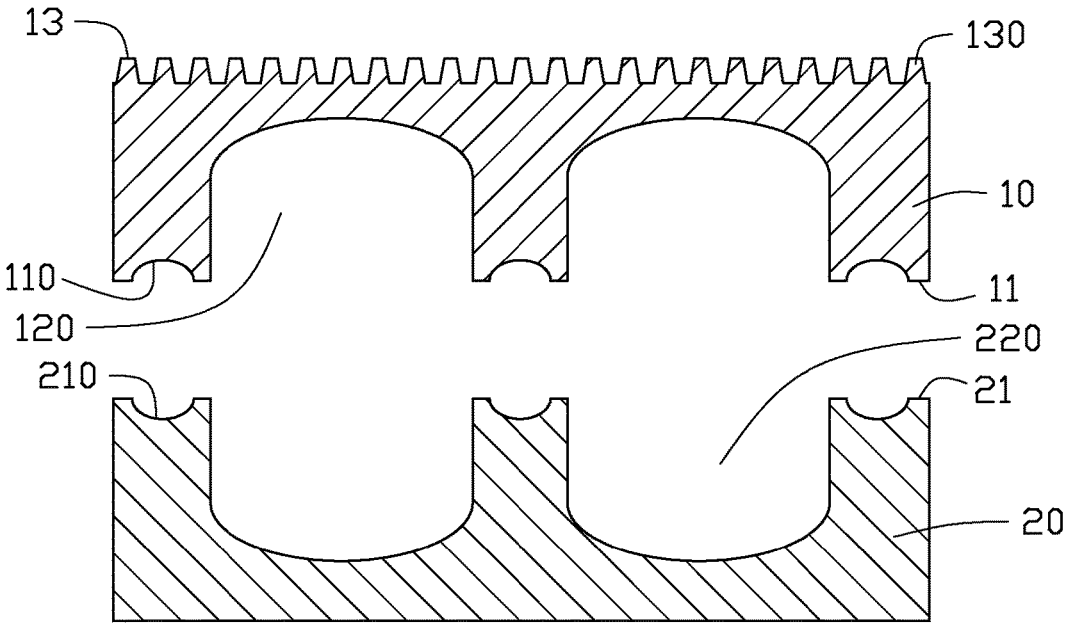
FIG. 8 is a diagrammatic view of the first surface is processed to form a plurality of first recesses and a plurality of cavities, the second surface is processed to form a plurality of second recesses and a plurality of second cavities.

At block 401, a first copper sheet 10, and a second copper sheet 20 are provided, as shown in FIG. 8. In the embodiment, the first copper sheet 10 and the second copper sheet 20 are substantially rectangular. The first copper sheet 10 includes a first surface 11 and a third surface 13 opposite to the first surface 11, the second copper sheet 20 includes a second surface 21 facing the first surface 11 and a fourth surface opposite to the second surface 23. A thickness of the first copper sheet 10 is the same as that of the second copper sheet 20, in the embodiment the thickness is about 140 um.

At block 402, the first surface 11 is etched to form a number of first recesses 110, the third surface 13 is etched to form a number of micro-fins 130, and the second surface 21 is etched to form a number of second recesses 210 and a number of cavities 220, as shown in FIG. 8. The second cavities 220 and the first cavities 120 have the same shape and size. A cross section of the first and second recesses 120 and 220 is arc-shaped or a semicircle-shaped. The first cavities 120, the second cavities 220 and the micro-fins 130 can be etched using a chemical solution or laser beam.

The cross section of the micro-fins 130 is substantially trapezoid. A height of the trapezoid is in a range from about 3 to 8 um, and a width of the trapezoid is in a range from about 30 to 40 um. A connecting strength between the micro-fins 130 with the third surface 13 can be increased for the trapezoid shape of the micro-fins 130.

Figure 9:
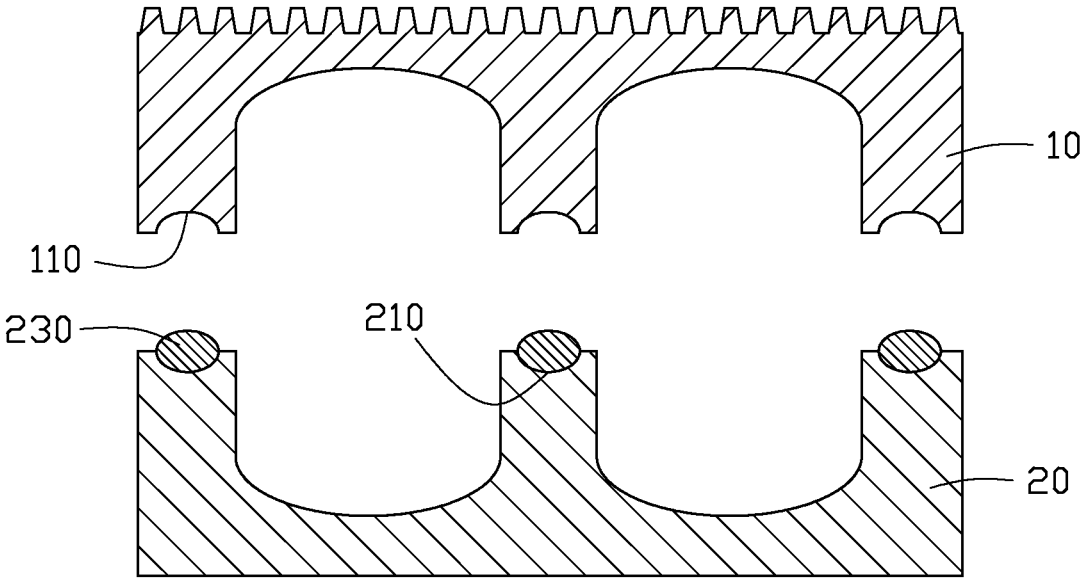
FIG. 9 is a diagrammatic view of an adhesive is filled on the second copper sheet in FIG. 6.

At block 403, an adhesive 230 is filled into the second recess 210 of the second copper sheet 10, as shown in FIG. 9. A melting point of the adhesive 230 is about 139 degrees or less, but higher than a boiling point of water. That is to say, when water is used for absorbing heat, the adhesive 230 will not melt. In the illustrated embodiment, the adhesive 230 is filled in the second recess 210 by a screen printing process.

The adhesive 230 is mainly comprised of resin material mixed with metal particles. The metal particles are selected from the group consisting of copper, silver, tin, bismuth and any combination thereof. A diameter of the metal particles is about from 25 to 45 um, a weight content of the metal particles is about 89.1 wt %-89.7 wt %, a weight content of the resin material is about 10.3 wt %-10.9 wt %. Preferably, the metal particles is Sn64AgBi35 alloy. The adhesive 230 with the specified above proportion has a better adhesion and less susceptibility to water.

Figure 10:
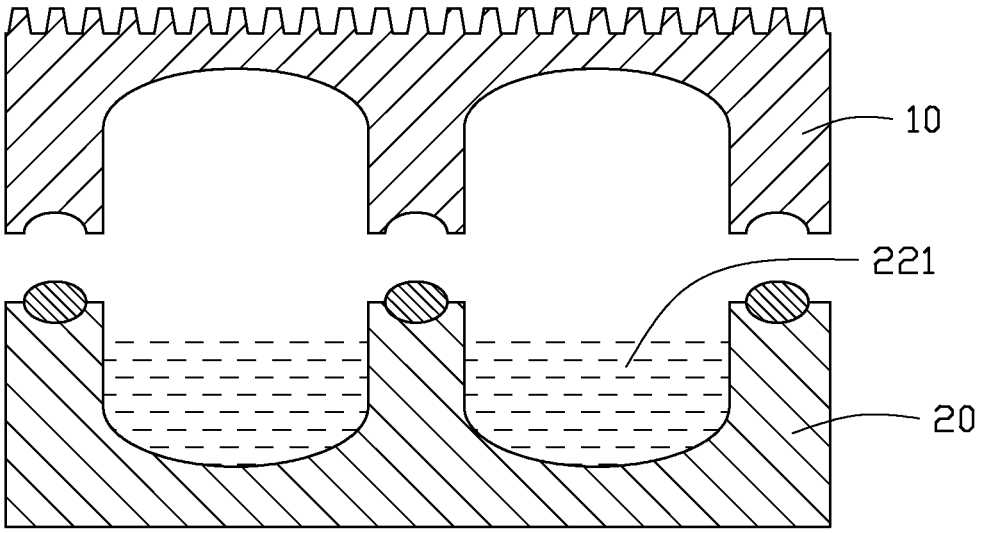
FIG. 10 is a diagrammatic view of a working fluid received in the second copper sheet.

At block 404, a working fluid 221 is filled into the second recesses 220, as shown in FIG. 10. The working fluid 221 can be selected from the group comprising water, methanol, ethanol, acetone, ammonia, paraffin, oil, and chlorofluorocarbons at least. In the illustrated embodiment, the working fluid 221 is water. A heat capacity of water is about 4.2×103 J/(kg·° C.), which is larger than a heat capacity of steel sheet.

Figure 11:
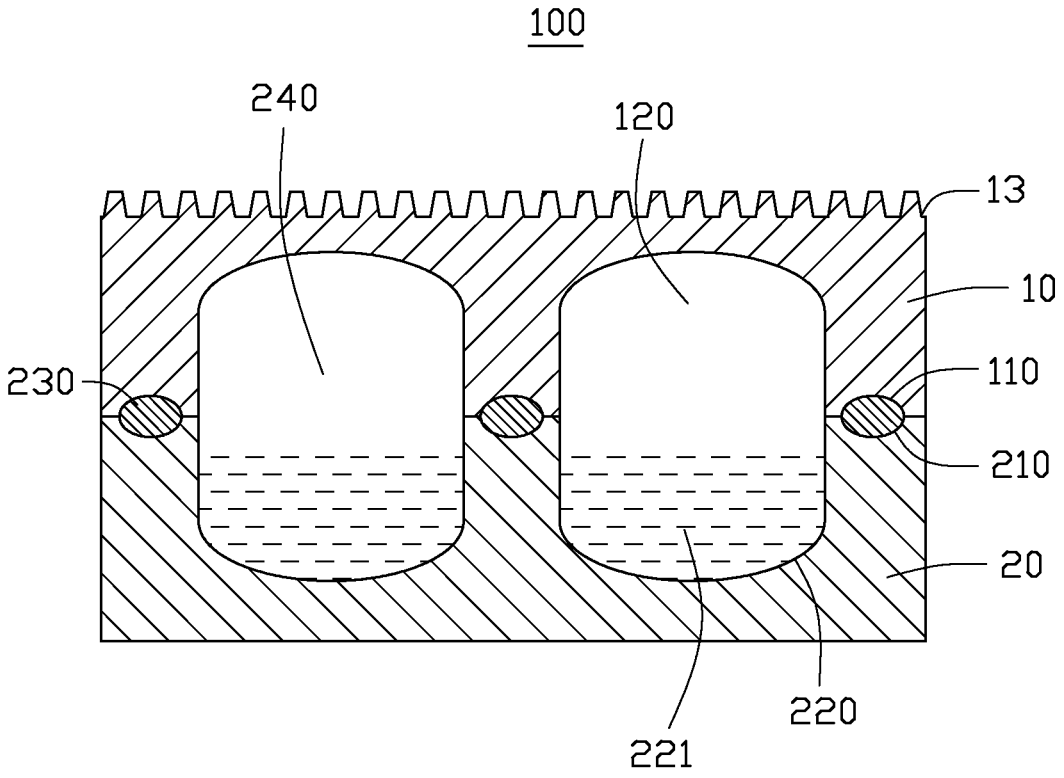
FIG. 11 is a diagrammatic view of the first copper sheet fixed with the second copper sheet.

At block 405, the first copper sheet 10 is pressed on the second copper sheet 20 and the second copper sheet 20 is in contact with the first copper sheet 10 by the adhesive 230, as shown in FIG. 11. Each of the first recesses 120 is corresponding to and in communication with one the second recesses 220, and each of the first recesses 120 and the corresponding second recesses 220 together form an airtight receiving cavity 404.

At block 406, the adhesive 230 is solidified, and the second copper sheet 20 is fixed with the first copper sheet 10, thereby, a heat dissipation device 100 is obtained.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A method for manufacturing the heat dissipation device, the method comprising:

providing a first copper sheet and a second copper sheet, the first copper sheet comprises a first surface and a third surface opposite to the first surface;

processing the first surface of the first copper sheet to form a plurality of first recesses and a plurality of first cavities in the first surface of the first copper sheet, processing the third surface of the first copper sheet to form a plurality of micro-fins in the third surface of the first copper sheet a height of the microfins in the range of 3 um to 8 um, the first cavities being surrounded by the first recesses, processing the second copper sheet to form a plurality of second recesses and a plurality of second cavities in the second copper sheet, each second recess corresponding to each first recess, each second cavity corresponding to each first cavity;

providing an adhesive on each second recess of the second copper sheet;

providing a working fluid in each second cavity of the second copper sheet;

pressing the first copper sheet on the second copper sheet, and the second copper sheet is fixed with the first copper sheet by the adhesive, each of the first cavities being in communication with a second cavity, each first cavity and each second cavity together forming an airtight receiving cavity;

solidifying the adhesive.

2. The method of claim 1, wherein a depth of each first recess is much smaller than a depth of the first cavity, a depth of each second recess is much smaller than a depth of the second cavity.

3. The method of claim 1, wherein the adhesive is low temperature solder paste.

4. The method of claim 1, wherein the adhesive comprises of molten resin material doped with metal particles, the metal particle is selected from the group comprising copper, silver, tin, bismuth and any combination thereof.

5. The method of claim 4, wherein a weight ratio of tin in the adhesive is in the range from 89.1 wt % to 89.7 wt %, and a weight ratio of molten resin in the adhesive is in the range from 10.3 wt % to 10.9 wt %.

6. The method of claim 1, wherein the cross section of the micro-fins is substantially trapezoidal.

7. The method of claim 6, wherein and a width of the trapezoid is in a range from about 30 um to 40 um.

8. The method of claim 1, wherein the first copper sheet includes a plurality of ribs between each first cavity, the micro-fins are formed at a location of the third surface which corresponds to the ribs.

9. The method of claim 1, wherein the first cavities, the second cavities, and the micro-fins are processed using a chemical etching solution or a laser ablation.

10. The method of claim 1, wherein the adhesive is infilled in the second recess by a screen printing process.

* * * * *